US011686113B2

(12) United States Patent
Gomez

(10) Patent No.: US 11,686,113 B2
(45) Date of Patent: Jun. 27, 2023

(54) CONCRETE FINISHING ASSEMBLY

(71) Applicant: Paul Gomez, Haines Falls, NY (US)

(72) Inventor: Paul Gomez, Haines Falls, NY (US)

( * ) Notice: Subject to any disclaimer, the term of this patent is extended or adjusted under 35 U.S.C. 154(b) by 262 days.

(21) Appl. No.: 17/177,662

(22) Filed: Feb. 17, 2021

(65) Prior Publication Data

US 2022/0259874 A1 Aug. 18, 2022

(51) Int. Cl.
*E04G 21/10* (2006.01)
*A47K 3/40* (2006.01)

(52) U.S. Cl.
CPC ..... *E04G 21/10* (2013.01); *A47K 3/405* (2013.01)

(58) Field of Classification Search
CPC ..... E04G 21/02; E04G 21/10; A47K 3/40; A47K 3/405; E04F 21/16; E04F 21/161; E04F 21/24; E04F 21/241; E04F 21/244
USPC ..... 15/235.4, 235.8
See application file for complete search history.

(56) References Cited

U.S. PATENT DOCUMENTS 4,055,321 A * 10/1977 Schimmel ..... B28B 7/22 249/185
4,465,257 A * 8/1984 Schimmel ..... E04G 11/02 249/185
4,723,869 A 2/1988 Dragich
4,795,332 A * 1/1989 Davis ..... E01C 19/402 404/112
5,261,144 A 11/1993 Mitchell
5,372,452 A 12/1994 Hodgson
5,579,557 A 12/1996 Boden
7,192,216 B2 * 3/2007 Casale ..... E04F 21/04 404/101
7,252,456 B1 * 8/2007 Face, III ..... E04F 21/241 404/112
7,464,432 B2 12/2008 Goller
7,470,083 B2 * 12/2008 Black ..... E04G 21/10 404/96
8,016,517 B1 9/2011 Pardue
8,104,992 B2 * 1/2012 Biodrowski ..... E04F 21/242 404/118
8,622,649 B1 * 1/2014 Peeroo ..... E01C 19/15 404/119
8,684,717 B2 * 4/2014 Kim ..... E04F 21/241 425/281
9,995,048 B1 6/2018 Gamelin
2008/0127592 A1 * 6/2008 Knapp ..... E04F 21/161 52/465
2010/0202831 A1 * 8/2010 Saranga ..... E04F 21/241 404/75

(Continued)

FOREIGN PATENT DOCUMENTS

WO WO03097939 11/2003

*Primary Examiner* — Ryan D Kwiecinski

(57) ABSTRACT

A concrete finishing assembly includes a plurality of rails that each has a guide surface. A plurality of couplers each releasably engages a respective pair of the rails for attaching the respective pair of rails together. In this way the plurality of rails defines a border to surround a shower floor. A cylinder is provided and the cylinder can be inserted into a drain in the shower floor. A trowel unit is provided that has an adjustable length and the trowel unit is attachable to the cylinder. The trowel unit is slidable along the guide surface of the plurality of rails that defines the border. In this way the trowel unit can smooth concrete on the shower floor at a predetermined slope for draining water into the drain.

12 Claims, 5 Drawing Sheets

(56) References Cited

U.S. PATENT DOCUMENTS

2013/0074279 A1 3/2013 Bridges

* cited by examiner

CONCRETE FINISHING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to finishing devices and more particularly pertains to a new finishing device for smoothing a concrete floor of a shower at a pre-determined slope. The device includes a frame that is positionable on a support surface to define a border around the concrete floor of the shower. Additionally, the device includes a trowel that attaches to a drain and which is slid along the frame for smoothing the concrete floor.

(2) Description of Related Art Including Information Disclosed Under 37 CFR 1.97 and 1.98

The prior art relates to finishing devices including a variety of concrete floats that have a unique structural design for smoothing concrete. The prior art also discloses a power trowel that includes a telescopic handle. The prior art also discloses a variety of trowel devices that have a uniquely designed handle for enhancing efficiency of a user manipulating the trowel devices. In no instance does the prior art disclose a trowel that mounts to a drain in a shower floor and which rests in a surrounding frame for smoothing concrete to slope into the drain.

BRIEF SUMMARY OF THE INVENTION

An embodiment of the disclosure meets the needs presented above by generally comprising a plurality of rails that each has a guide surface. A plurality of couplers each releasably engages a respective pair of the rails for attaching the respective pair of rails together. In this way the plurality of rails defines a border to surround a shower floor. A cylinder is provided and the cylinder can be inserted into a drain in the shower floor. A trowel unit is provided that has an adjustable length and the trowel unit is attachable to the cylinder. The trowel unit is slidable along the guide surface of the plurality of rails that defines the border. In this way the trowel unit can smooth concrete on the shower floor at a predetermined slope for draining water into the drain.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
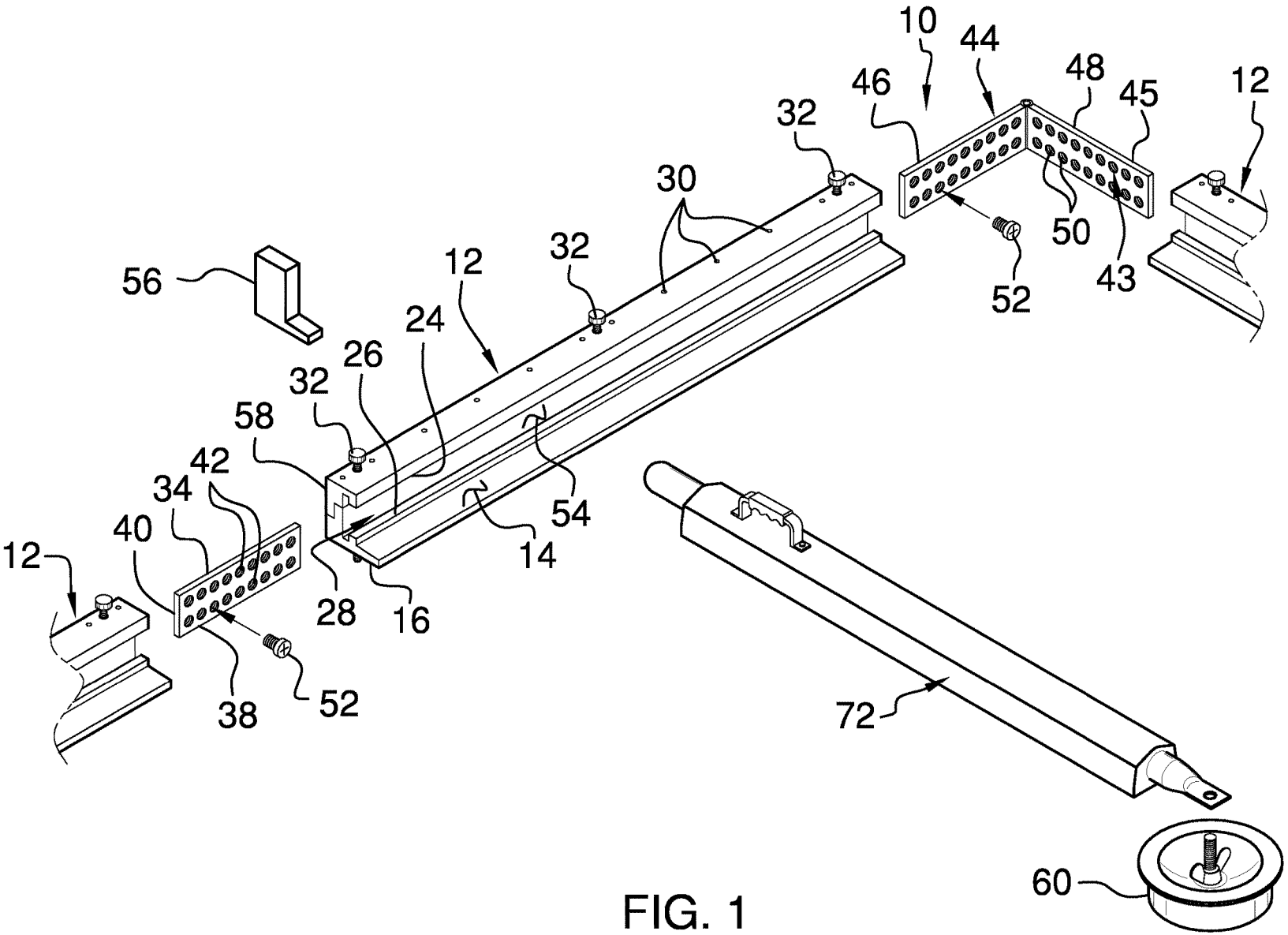
FIG. 1 is an exploded perspective view of a concrete finishing assembly according to an embodiment of the disclosure.
Figure 3:
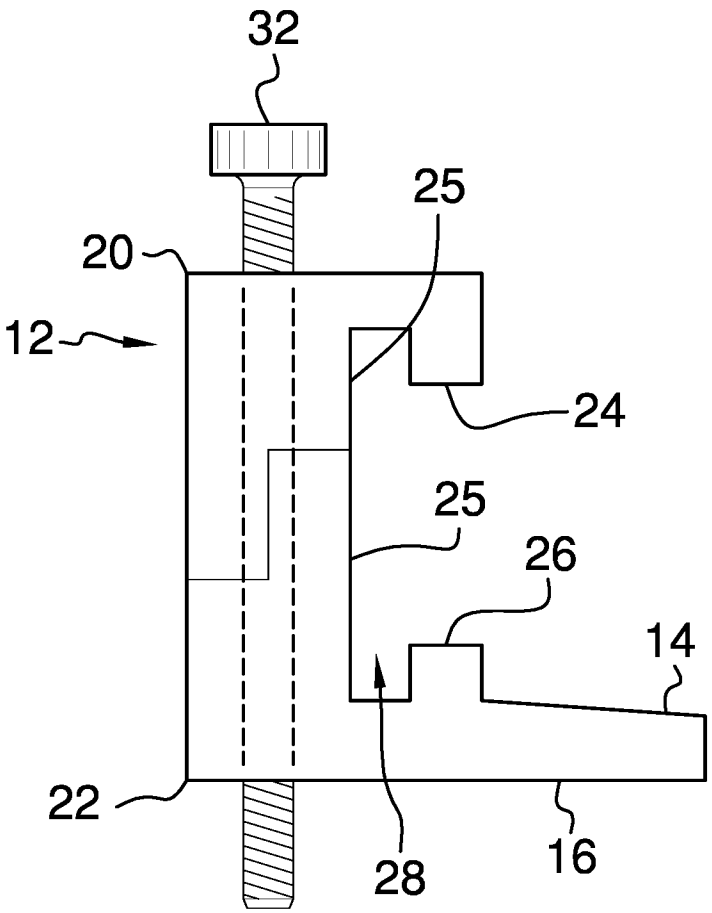
FIG. 3 is a right side view of top half and a bottom half of a rail of an embodiment of the disclosure being attached together.
Figure 2:
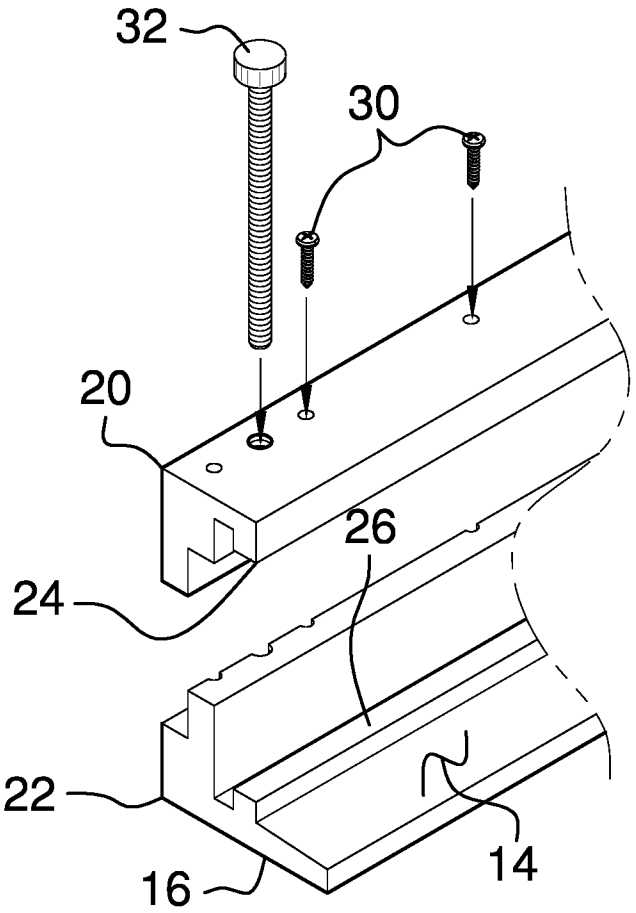
FIG. 2 is a perspective view of a top half and a bottom half of a rail of an embodiment of the disclosure.
Figure 4:
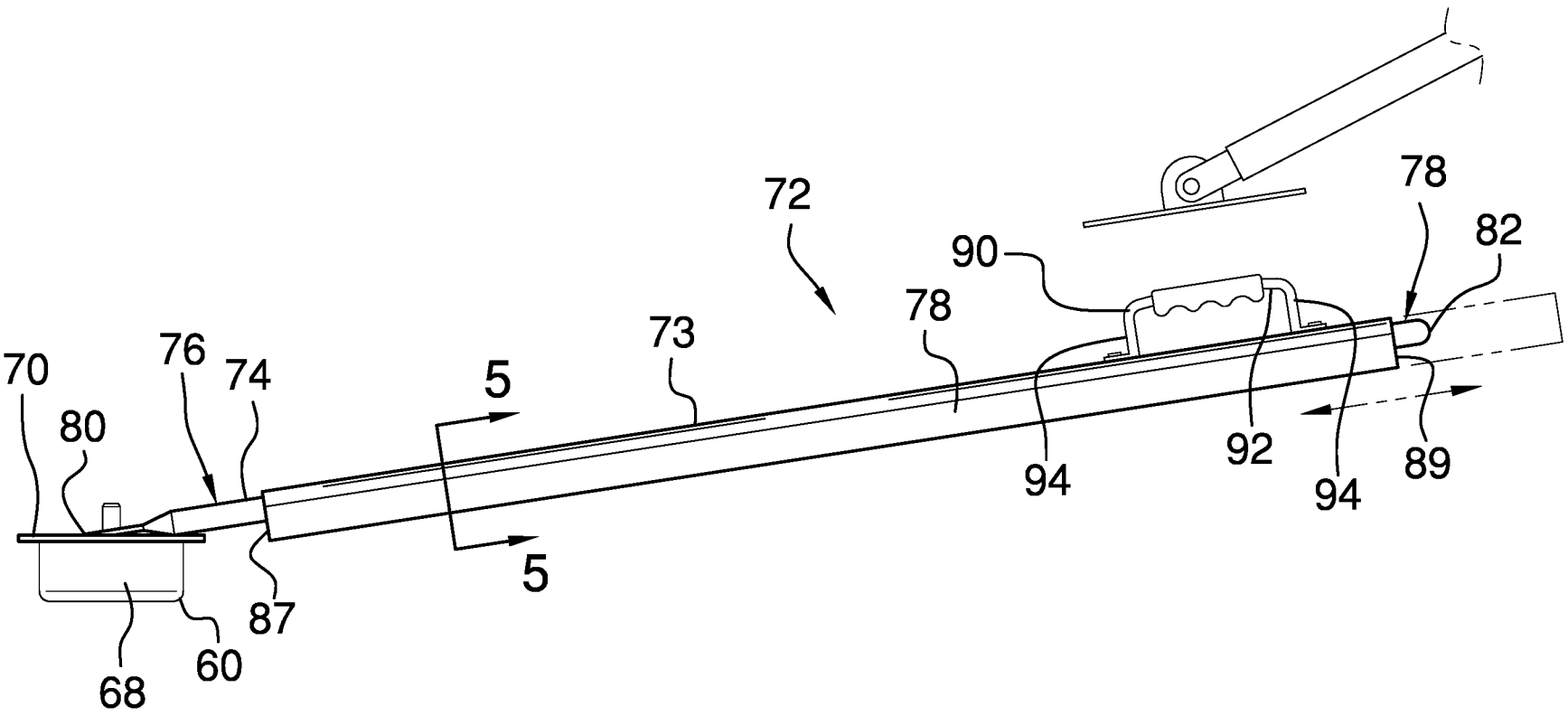
FIG. 4 is a perspective view of a cylinder and a trowel unit of an embodiment of the disclosure.
Figure 6:
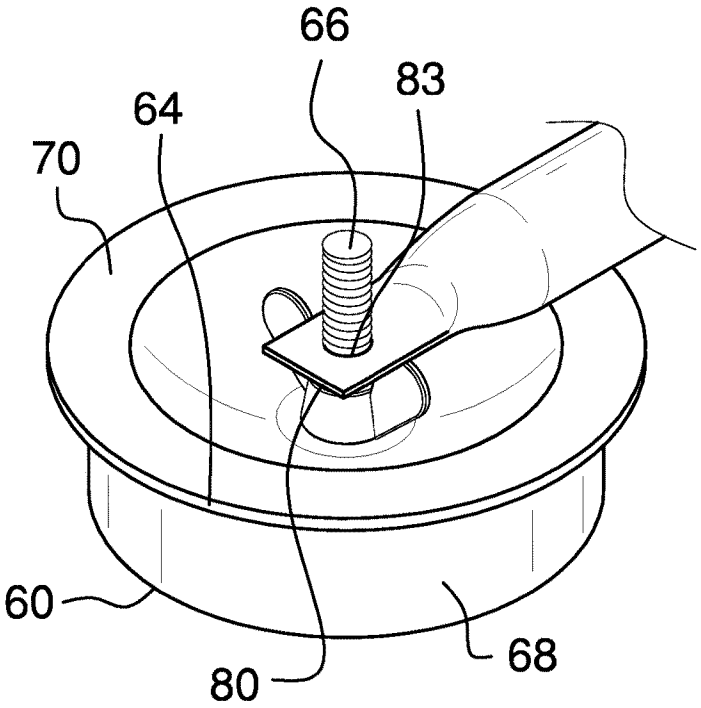
FIG. 6 is a top perspective view of a cylinder of an embodiment of the disclosure.
Figure 5:
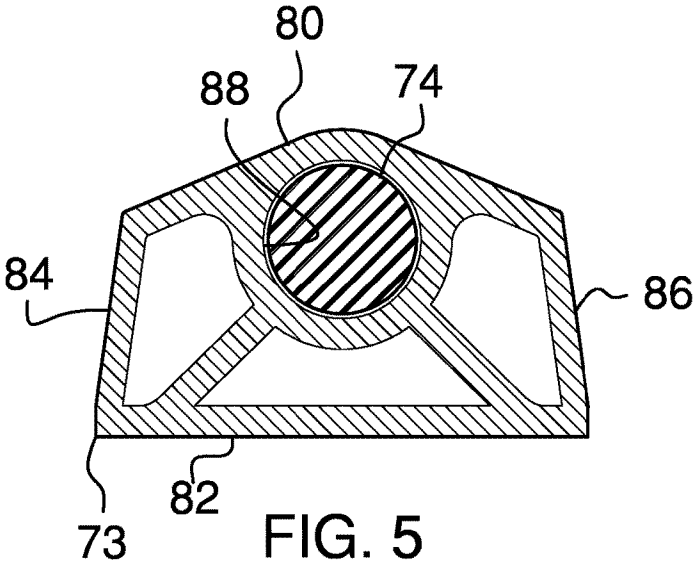
FIG. 5 is a cross sectional view taken along line 5-5 of FIG. 4 of an embodiment of the disclosure.
Figure 7:
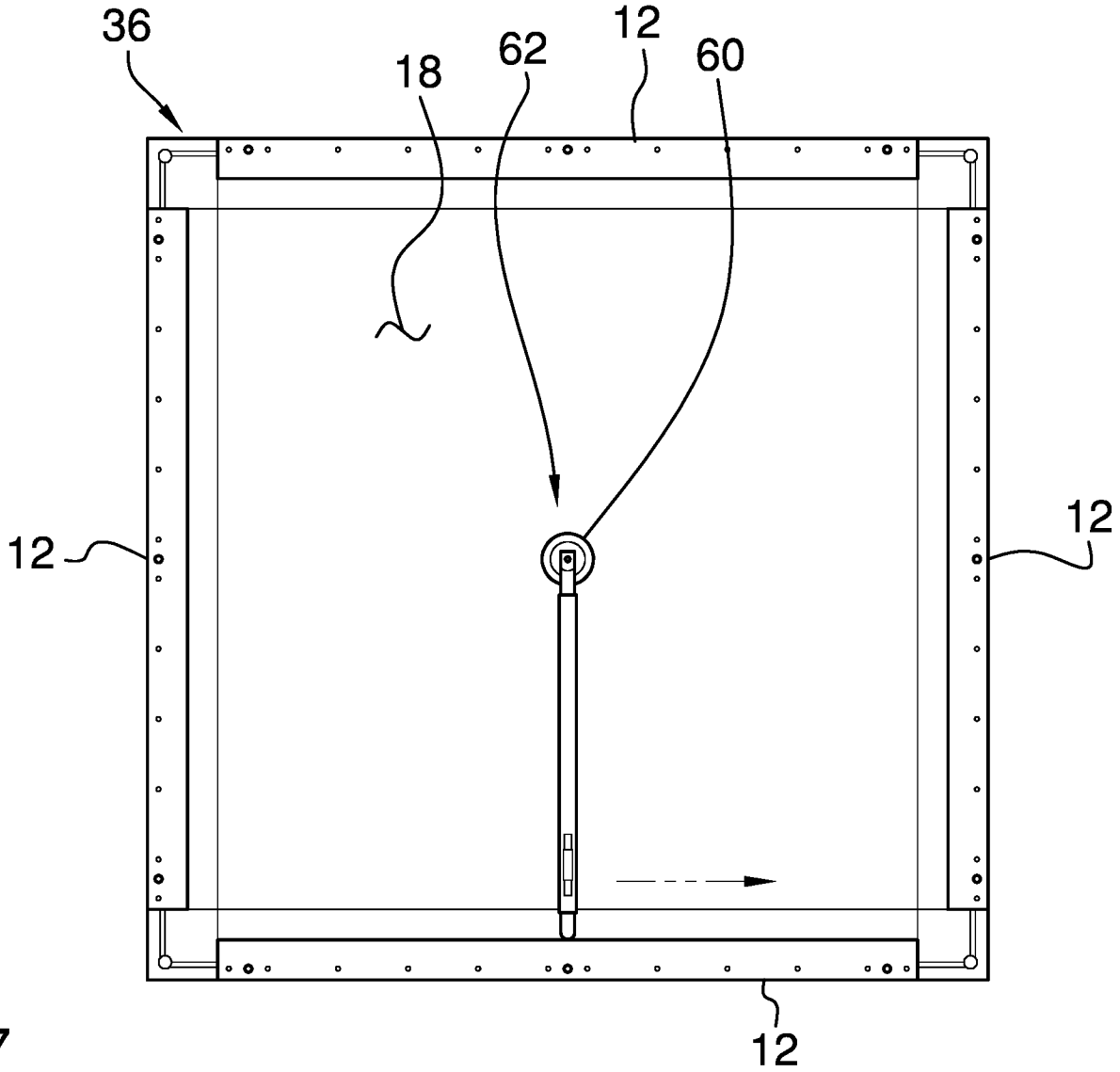
FIG. 7 is a perspective in-use view of an embodiment of the disclosure.

With reference now to the drawings, and in particular to FIGS. 1 through 7 thereof, a new finishing device embodying the principles and concepts of an embodiment of the disclosure and generally designated by the reference numeral 10 will be described.

As best illustrated in FIGS. 1 through 7, the concrete finishing assembly 10 generally comprises a plurality of rails 12 that each has a guide surface 14 and a bottom surface 16 that rests on a support surface 18. The support surface 18 may be a subfloor upon which concrete will be poured to produce a shower floor. Each of the rails 12 comprises a top half 20 that is attachable to a bottom half 22. Additionally, each of the bottom surface 16 and the guide surface 14 is associated with the bottom half 22.

The top half 20 has a top tab 24 extending downwardly therefrom, the top tab 24 extends along a full length of the top half 20 and the top tab 24 is spaced from a rear threshold 25 of the top half 20. The bottom half 22 has a bottom tab 26 extending upwardly therefrom, the bottom tab 26 extends along a full length of the bottom half 22 and the bottom tab 26 is spaced from a rear threshold 25 of the bottom half 22.

Moreover, the bottom tab 26 is aligned with the top tab 24 when the top half 20 is attached to the bottom half 22 such that each of the top tab 24 and the bottom tab 26 defines a channel 28 extending along a full length of the rail 12 defined by the top half 20 the bottom half 22. The guide surface 14 extends beyond the bottom tab 26 such that the guide surface 14 is exposed when the top half 20 is attached to the bottom half 22. Additionally, the guide surface 14 lies on a plane that is approximately horizontal when the rails 12 are positioned on the support surface 18. Each of the rails 12 may have a length ranging between approximately 0.5 meters and 1.5 meters.

A plurality of fasteners 30 is provided and each of the fasteners 30 extends through the top half 20 and engages the bottom half 22 for attaching the top half 20 to the bottom half 22. Each of the fasteners 30 may comprise a screw, a clamp or other type of releasable, mechanical fastener. A plurality of leveling screws 32 is each threadable through the top half 20 and the bottom half 22 when the top half 20 is attached to the bottom half 22. Each of the leveling screws 32 extends through the bottom surface 16 of the bottom half 22. In this way each of the leveling screws 32 can abut the support surface 18 for leveling the guide surface 14.

A plurality of couplers 34 is provided and each of the couplers 34 releasably engages a respective pair of the rails 12 for attaching the respective pair of rails 12 together. In this way the plurality of rails 12 can define a border 36 to surround a shower floor. Each of the couplers 34 has a front surface 38 and a back surface 40, and each of the couplers 34 has a plurality of apertures 42 each extending through the front surface 38 and the back surface 40. Each of the couplers 34 is elongated and each of the couplers 34 is insertable into the channel 28 defined in the respective pair of rails 12 having the respective rails 12 abutting each other. In this way the respective pair of rails 12 is oriented to extend along a common line.

A plurality of hinged couplers 44 is provided and each of the hinged couplers 44 comprises a first half that is hingedly coupled to a second half 48. Each of the hinged couplers 44 releasably engages a respective pair of the rails 12 for attaching the respective pair of rails 12 together. In this way the plurality of rails 12 defines the border 36 to surround the shower floor. Each of the hinged couplers 44 has a front surface 43 and a back surface 45, and each of the hinged couplers 44 has a plurality of apertures 50 each extending through the front surface 43 and the back surface 45. Each of the hinged couplers 44 is elongated and each of the hinged couplers 44 is insertable into the channel 28 defined in the respective pair of rails 12. In this way the respective pair of rails 12 can be oriented at an angle with respect to each other for defining corners of the border 36.

A plurality of coupler fasteners 52 is each extendable through a respective one of the apertures 42 in a respective one of the couplers 34 or the hinged couplers 44. Each of the coupler fasteners 52 engages an engaging surface 54 in a respective one of the rails 12 when the coupler fasteners 52 are tightened. The engaging surface 54 is defined by rear threshold 25 of each of the top half 20 and the bottom half 22 when the top half 20 and the bottom half 22 are attached to each other. In this way the respective couplers 34 or hinged couplers 44 is retained in the respective pair of rails 12. Each of the coupler fasteners 52 may comprise a set screw or other similar type of releasable fastener. A cap 56 is provided and the cap 56 is attachable to an end 58 of a respective rail 12 that is not attached to another rail 12. The cap 56 is comprised of a resiliently compressible material thereby facilitating the cap 56 to be abutted against a wall of the shower.

A cylinder 60 is provided and the cylinder 60 can be inserted into a drain 62 in the shower floor. The cylinder 60 has an upper end 64, and the upper end 64 has a rod screw 66 extending upwardly therefrom. The cylinder 60 has an outer wall 68 that may be comprised of a deformable material, such as rubber or other similar material. A disk 70 may be positioned on the upper end 64 of the cylinder 60 to facilitate the cylinder 60 to be compressed when a nut is tightened onto the screw. In this way the outer wall 68 expands outwardly to compress against the drain 62 to retain the cylinder 60 in the drain 62. The cylinder 60 may be manufactured in a variety of dimensions for fitting various types of drains.

A trowel unit 72 is provided and the trowel unit 72 has an adjustable length. The trowel unit 72 is attachable to the cylinder 60 and the trowel unit 72 is slidable along the guide surface 14 of the plurality of rails 12 that defines the border 36. In this way the trowel unit 72 can smooth concrete on the shower floor at a predetermined slope for draining water into the drain. The trowel unit 72 comprises a rod 74 comprising a first portion 76 that slidably engages a second portion 78 such that the rod 74 has a telescopically adjustable length. The first portion 76 has a first end 80, the second portion 78 has a second end 82, and the first end 80 is flattened.

The rod 74 has a hole 83 extending therethrough and the hole 83 is positioned adjacent to the first end 80. The hole 83 insertably receives the rod screw 66 on the cylinder 60 for pivotally attaching the rod 74 to the cylinder 60. Additionally, the second end 82 of the second section rests on the guide surface 14 of the plurality of rails 12. A nut is threaded onto the screw when the rod 74 is positioned on the screw for securing the rod 74 to the cylinder 60.

The trowel unit 72 includes a trowel 73 that has a primary end 87, a secondary end 89 and an outer wall 78 extending therebetween, and the outer wall 78 has a top side 80, a bottom side 82, a first lateral side 84 and a second lateral side 86. Each of the first lateral side 84 and the second lateral side 86 angles inwardly between the bottom side 82 and the top side 80 such that the trowel 73 has a trapezoidal cross section taken along a line extending through the primary end 87 and the secondary end 89. The trowel 73 has an opening 88 extending through the primary end 87 and the secondary end 89. The rod 74 extends through the opening 88 such that the trowel 73 is slidable along the rod 74. In this way the bottom side 82 of the outer wall 78 can smooth the concrete to the predetermined slope as the rod 74 is slid along the guide surface 14 of the plurality of rails 12 which define the border 36.

A handle 90 is coupled to the top side 80 of the outer wall 78 of the trowel 73 and the handle 90 can be gripped for manipulating the trowel 73. The handle 90 comprises a central member 92 extending between a pair of outward members 94. Each of the outward members 94 extends upwardly from the top side 80 of the outer wall 78 having the central member 92 being spaced from the top side 80. In this way the central member 92 can be gripped for manipulating the trowel 73.

In use, the rails 12 are assembled together and arranged to define the border 36 that surrounds the floor of the shower. Each rails 12 is leveled with the leveling screws 32 such that the guide surface 14 is level and is spaced a predetermined distance from the support surface 18. The cylinder 60 is positioned in the drain 62, the rod 74 is attached to the cylinder 60 and the rod 74 is laid on the guide surface 14 of a respective rail 12. In this way the trowel 73 is retained at a predetermined height for smoothing concrete that is poured to define the floor of the shower. The rod 74 is slid along the entire perimeter of the border 36 defined by the rails 12 until all of the concrete has been smoothed. In this way the floor of the shower can be precisely sloped to enhance draining water into the drain 62.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A concrete finishing assembly for smoothing a sloped shower floor, said assembly comprising:

a plurality of rails, each of said rails having a guide surface and a bottom surface wherein said bottom surface is configured to rest on a support surface;

a plurality of couplers, each of said couplers releasably engaging a respective pair of said rails for attaching said respective pair of rails together thereby facilitating said plurality of rails define a border wherein said border is configured to surround a shower floor;

a plurality of hinged couplers, each of said hinged couplers comprising a first half being hingedly coupled to a second half, each of said hinged couplers releasably engaging a respective pair of said rails for attaching said respective pair of rails together thereby facilitating said plurality of rails define a border wherein said border is configured to surround the shower floor;

a cylinder being configured to be inserted into a drain in the shower floor;

a trowel unit having an adjustable length, said trowel unit being attachable to said cylinder, said trowel unit being slidable along said guide surface of said plurality of rails that defines said border wherein said trowel unit is configured to smooth concrete on the shower floor at a predetermined slope for draining water into the drain; and wherein said trowel unit includes a trowel having a primary end, a secondary end and an outer wall extending therebetween, said outer wall having a top side, a bottom side, a first lateral side and a second lateral side, each of said first lateral side and said second lateral side angling inwardly between said bottom side and said top side such that said trowel has a trapezoidal cross section taken along a line extending through said primary end and said secondary end.

2. The assembly according to claim 1, wherein said cylinder has an upper end, said upper end having a rod screw extending upwardly therefrom.

3. The assembly according to claim 1, wherein:

said trowel includes a rod; and said trowel has an opening extending through said primary end and said secondary end, said opening having said rod extending therethrough such that said trowel is slidable along said rod wherein said bottom side of said outer wall is configured to smooth the concrete to the predetermined slope as said rod is slid along said guide surface of said plurality of rails defining said border.

4. The assembly according to claim 1, further comprising a handle being coupled to said top side of said outer wall of said trowel wherein said handle is configured to be gripped for manipulating said trowel, said handle comprising a central member extending between a pair of outward members, each of said outward members extending upwardly from said top side of said outer wall having said central member being spaced from said top side wherein said central member is configured to be gripped.

5. The concrete finishing assembly according to claim 1, further comprising:

each of said rails comprising a top half being attachable to a bottom half, each of said bottom surface and said guide surface being associated with said bottom half, said top half having a top tab extending downwardly therefrom, said top tab extending along a full length of said top half, said top half tab being spaced from a rear threshold of said top half, said bottom half having a bottom tab extending upwardly therefrom, said bottom tab extending along a full length of said bottom half, said bottom tab being spaced from a rear threshold of said bottom half, said bottom tab being aligned with said top tab when said top half is attached to said bottom half such that each of said top tab and said bottom tab defines a channel extending along a full length of said rail defined by said top half said bottom half, said guide surface extending beyond said bottom tab such that said guide surface is exposed when said top half is attached to said bottom half;

a plurality of fasteners, each of said fasteners extending through said top half and engaging said bottom half for attaching said top half to said bottom half;

a plurality of leveling screws, each of said leveling screws being threadable through said top half and said bottom half when said top half is attached to said bottom half, each of said leveling screws extending through said bottom surface of said bottom half wherein each of said leveling screws is configured to abut the support surface for leveling said guide surface;

each of said couplers having a front surface and a back surface, each of said couplers having a plurality of apertures each extending through said front surface and said back surface, each of said couplers being elongated, each of said couplers being insertable into said channel defined in said respective pair of rails having said respective rails abutting each other such that said respective pair of rails is oriented to extend along a common line;

each of said hinged couplers having a front surface and a back surface, each of said hinged couplers having a plurality of apertures each extending through said front surface and said back surface, each of said hinged couplers being elongated, each of said hinged couplers being insertable into said channel defined in said respective pair of rails having said respective pair of rails being oriented at an angle with respect to each other for defining corners of said border;

a plurality of coupler fasteners, each of said coupler fasteners being extendable through a respective one of said apertures in a respective one of said couplers or said hinged couplers, each of said coupler fasteners engaging an engaging surface in a respective one of said rails when said coupler fasteners is tightened for retaining said respective couplers or hinged couplers in said respective pair of rails;

said cylinder having an upper end, said upper end having a rod screw extending upwardly therefrom; and said trowel unit comprising:

a rod comprising a first portion that slidably engages a second portion such that said rod has a telescopically adjustable length, said first portion having a first end, said second portion having a second end, said first end being flattened, said rod having a hole extending therethrough, said hole being positioned adjacent to said first end, said hole insertably receiving said rod screw on said cylinder for pivotally attaching said rod to said cylinder, said second end of said second section resting on said guide surface of said plurality of rails;

said trowel having an opening extending through said primary end and said secondary end, said opening having said rod extending therethrough such that said trowel is slidable along said rod wherein said bottom side of said outer wall is configured to smooth the concrete to the predetermined slope as said rod is slid along said guide surface of said plurality of rails defining said border; and a handle being coupled to said top side of said outer wall of said trowel wherein said handle is configured to be gripped for manipulating said trowel, said handle comprising a central member extending between a pair of outward members, each of said outward members extending upwardly from said top side of said outer wall having said central member being spaced from said top side wherein said central member is configured to be gripped.

6. A concrete finishing assembly for smoothing a sloped shower floor, said assembly comprising:

a plurality of rails, each of said rails having a guide surface and a bottom surface wherein said bottom surface is configured to rest on a support surface;

a plurality of couplers, each of said couplers releasably engaging a respective pair of said rails for attaching said respective pair of rails together thereby facilitating said plurality of rails define a border wherein said border is configured to surround a shower floor;

a plurality of hinged couplers, each of said hinged couplers comprising a first half being hingedly coupled to a second half, each of said hinged couplers releasably engaging a respective pair of said rails for attaching said respective pair of rails together thereby facilitating said plurality of rails define a border wherein said border is configured to surround the shower floor;

a cylinder being configured to be inserted into a drain in the shower floor;

a trowel unit having an adjustable length, said trowel unit being attachable to said cylinder, said trowel unit being slidable along said guide surface of said plurality of rails that defines said border wherein said trowel unit is configured to smooth concrete on the shower floor at a predetermined slope for draining water into the drain; and wherein each of said rails comprises a top half being attachable to a bottom half, each of said bottom surface and said guide surface being associated with said bottom half, said top half having a top tab extending downwardly therefrom, said top tab extending along a full length of said top half, said top tab being spaced from a rear threshold of said top half, said bottom half having a bottom tab extending upwardly therefrom, said bottom tab extending along a full length of said bottom half, said bottom tab being spaced from a rear threshold of said bottom half.

7. The assembly according to claim 6, wherein said bottom tab is aligned with said top tab when said top half is attached to said bottom half such that each of said top tab and said bottom tab defines a channel extending along a full length of said rail defined by said top half said bottom half, said guide surface extending beyond said bottom tab such that said guide surface is exposed when said top half is attached to said bottom half.

8. The assembly according to claim 7, wherein each of said couplers has a front surface and a back surface, each of said couplers having a plurality of apertures each extending through said front surface and said back surface, each of said couplers being elongated, each of said couplers being insertable into said channel defined in said respective pair of rails having said respective rails abutting each other such that said respective pair of rails is oriented to extend along a common line.

9. The assembly according to claim 7, wherein each of said hinged couplers has a front surface and a back surface, each of said hinged couplers having a plurality of apertures each extending through said front surface and said back surface, each of said hinged couplers being elongated, each of said hinged couplers being insertable into said channel defined in said respective pair of rails having said respective pair of rails being oriented at an angle with respect to each other for defining corners of said border.

10. The assembly according to claim 6, further comprising a plurality of fasteners, each of said fasteners extending through said top half and engaging said bottom half for attaching said top half to said bottom half.

11. The assembly according to claim 6, further comprising a plurality of leveling screws, each of said leveling screws being threadable through said top half and said bottom half when said top half is attached to said bottom half, each of said leveling screws extending through said bottom surface of said bottom half wherein each of said leveling screws is configured to abut the support surface for leveling said guide surface.

12. A concrete finishing assembly for smoothing a sloped shower floor, said assembly comprising:

a plurality of rails, each of said rails having a guide surface and a bottom surface wherein said bottom surface is configured to rest on a support surface;

a plurality of couplers, each of said couplers releasably engaging a respective pair of said rails for attaching said respective pair of rails together thereby facilitating said plurality of rails define a border wherein said border is configured to surround a shower floor;

a plurality of hinged couplers, each of said hinged couplers comprising a first half being hingedly coupled to a second half, each of said hinged couplers releasably engaging a respective pair of said rails for attaching said respective pair of rails together thereby facilitating said plurality of rails define a border wherein said border is configured to surround the shower floor;

a cylinder being configured to be inserted into a drain in the shower floor;

a trowel unit having an adjustable length, said trowel unit being attachable to said cylinder, said trowel unit being slidable along said guide surface of said plurality of rails that defines said border wherein said trowel unit is configured to smooth concrete on the shower floor at a predetermined slope for draining water into the drain;

wherein said cylinder has an upper end, said upper end having a rod screw extending upwardly therefrom; and wherein said trowel unit comprises a rod comprising a first portion that slidably engages a second portion such that said rod has a telescopically adjustable length, said first portion having a first end, said second portion having a second end, said first end being flattened, said rod having a hole extending therethrough, said hole being positioned adjacent to said first end, said hole insertably receiving said rod screw on said cylinder for pivotally attaching said rod to said cylinder, said second end of said second section resting on said guide surface of said plurality of rails.

* * * * *